US009043231B2

(12) United States Patent
Gadola et al.

(10) Patent No.: US 9,043,231 B2
(45) **Date of Patent: *May 26, 2015**

(54) TRANSACTION PRODUCT ASSEMBLY WITH VEHICLE

(71) Applicant: TARGET BRANDS, INC., Minneapolis, MN (US)

(72) Inventors: Jesse Gadola, Minneapolis, MN (US); Brian Robert Bennett, St. Paul, MN (US); Kelly M. Gray, Minneapolis, MN (US); Brian R. Holt, Minneapolis, MN (US); Megan B. Engeseth, Minneapolis, MN (US); Timothy P. Clegg, Manhatten Beach, CA (US)

(73) Assignee: Target Brands, Inc., Minneapolis, MN (US)

( * ) Notice: Subject to any disclaimer, the term of this patent is extended or adjusted under 35 U.S.C. 154(b) by 267 days.

This patent is subject to a terminal disclaimer.

(21) Appl. No.: 13/667,981

(22) Filed: Nov. 2, 2012

(65) Prior Publication Data

US 2014/0127964 A1 May 8, 2014

(51) Int. Cl.
*G06F 17/30* (2006.01)
*A63H 17/26* (2006.01)
(Continued)

(52) U.S. Cl.
CPC ..... *A63H 17/26* (2013.01); *B65D 75/368* (2013.01); *B65D 2203/02* (2013.01); *B65D 2203/06* (2013.01); *B65D 2203/10* (2013.01); *A63H 30/04* (2013.01); *A63H 17/00* (2013.01)

(58) Field of Classification Search
CPC . G06Q 20/105; G06Q 20/28; G06Q 20/3278; A63H 20/04
USPC ..... 705/27, 41, 39, 44; 235/494, 493, 487; 446/80
See application file for complete search history.

(56) References Cited

U.S. PATENT DOCUMENTS 1,687,304 A 10/1928 Morris
D82,233 S 1/1930 Wetzell
(Continued)

FOREIGN PATENT DOCUMENTS

GB 2277482 A 2/1994

OTHER PUBLICATIONS

Office Action from Canadian Patent Application No. 2,808,566, mailed Nov. 13, 2013 (2 pages).
(Continued)

*Primary Examiner* — Vanel Frenel
(74) *Attorney, Agent, or Firm* — JoAnn M. Seaton; Griffiths & Seaton PLLC

(57) ABSTRACT

An assembly includes a transaction product and an auxiliary vehicle. The transaction product includes a folded sheet configured to be repeatedly folded and unfolded between a collapsed position and an extended position. The folded sheet defines a substantially planar surface defining a printed track. The transaction product comprises an account identifier statically connected thereto. The account identifier links the transaction product to at least one of an account and a record and is machine readable by a point-of-sale terminal. The auxiliary vehicle includes a microcontroller, one or more sensors, a motor, and at least one movable component. The microcontroller actuates the motor to induce movement of the at least one movable component propelling the auxiliary vehicle along and following the printed track based on detection of a location of the printed track as determined by the one or more sensors.

22 Claims, 11 Drawing Sheets

(51) Int. Cl.

| | |
|---|---|
| ***B65D 75/36*** | (2006.01) |
| ***A63H 30/04*** | (2006.01) |
| ***A63H 17/00*** | (2006.01) |

(56) References Cited

U.S. PATENT DOCUMENTS

| | | | |
|---|---|---|---|
| 2,458,729 | A | 1/1949 | Politzer |
| 2,525,937 | A | 10/1950 | Palm |
| D217,874 | S | 6/1970 | French |
| 3,810,515 | A | 5/1974 | Ingro |
| 4,140,317 | A | 2/1979 | Ramney |
| 4,620,725 | A | 11/1986 | Maehashi |
| 4,826,212 | A | 5/1989 | Muth et al. |
| D303,408 | S | 9/1989 | Wallace |
| 4,907,804 | A | 3/1990 | Arad et al. |
| 4,990,117 | A | 2/1991 | Yonezawa |
| 5,096,204 | A | 3/1992 | Lippman |
| 5,100,151 | A | 3/1992 | Lyon et al. |
| 5,156,898 | A | 10/1992 | McDonald |
| 5,190,295 | A | 3/1993 | Togni |
| 5,308,118 | A | 5/1994 | Ovadia |
| 5,308,121 | A | 5/1994 | Gunn |
| 5,351,991 | A | 10/1994 | McDonald |
| 5,454,644 | A | 10/1995 | Augustin |
| 5,503,434 | A | 4/1996 | Gunn |
| 5,868,429 | A | 2/1999 | Raymond et al. |
| 5,882,763 | A | 3/1999 | Perttunen et al. |
| 5,945,195 | A | 8/1999 | McDonald |
| RE36,395 | E | 11/1999 | McDonald |
| 6,000,986 | A | 12/1999 | Kaufman |
| 6,007,895 | A | 12/1999 | McDonald |
| 6,056,323 | A | 5/2000 | McDonald |
| D428,136 | S | 7/2000 | Cady et al. |
| 6,103,332 | A | 8/2000 | McDonald |
| 6,120,228 | A | 9/2000 | Exline |
| D434,653 | S | 12/2000 | Maguire |
| 6,354,985 | B2 | 3/2002 | Huber |
| 6,410,114 | B1 | 6/2002 | McDonald |
| 6,572,149 | B2 | 6/2003 | Long |
| D476,808 | S | 7/2003 | Carr |
| D481,867 | S | 11/2003 | Hotz |
| 6,695,668 | B2 | 2/2004 | Donahue et al. |
| 7,014,525 | B2 | 3/2006 | Abe et al. |
| 7,047,677 | B2 | 5/2006 | Rambaldi |
| 7,200,960 | B1 | 4/2007 | Waggoner et al. |
| 7,211,311 | B2 | 5/2007 | McDonald |
| D551,977 | S | 10/2007 | Daniels |
| 7,409,788 | B2 | 8/2008 | Lauer et al. |
| 7,445,157 | B2 | 11/2008 | Clegg et al. |
| 7,584,558 | B2 | 9/2009 | Boyd et al. |
| 7,614,548 | B2 | 11/2009 | Schultz et al. |
| 7,717,347 | B2 | 5/2010 | Boyd et al. |
| D620,539 | S | 7/2010 | Badanjo |
| 7,758,399 | B2 | 7/2010 | Weiss et al. |
| 7,810,710 | B2 | 10/2010 | Halbur et al. |
| 7,841,520 | B2 | 11/2010 | Schultz et al. |
| D632,742 | S | 2/2011 | Mueller |
| D632,743 | S | 2/2011 | Mueller |
| 7,891,122 | B2 | 2/2011 | Lauer et al. |
| 7,905,761 | B2 | 3/2011 | Weiss et al. |
| D641,248 | S | 7/2011 | Steger et al. |
| D650,438 | S | 12/2011 | Albrecht et al. |
| 8,070,054 | B2 | 12/2011 | Halbur et al. |
| D657,924 | S | 4/2012 | Soegaard |
| 8,152,058 | B2 | 4/2012 | Halbur et al. |
| D658,820 | S | 5/2012 | Stockwell |
| D661,895 | S | 6/2012 | Kinnard |
| 8,220,799 | B2 | 7/2012 | Pompei et al. |
| D665,577 | S | 8/2012 | Hollinger |
| D671,599 | S | 11/2012 | Herndon |
| D679,196 | S | 4/2013 | Dos Santos et al. |
| 2002/0143697 | A1 | 10/2002 | Gotfried |
| 2003/0157308 | A1 | 8/2003 | McDonald |
| 2004/0007814 | A1 | 1/2004 | Senart |
| 2004/0251678 | A1 | 12/2004 | Dacey |
| 2005/0023822 | A1 | 2/2005 | McDonald |
| 2005/0040585 | A1 | 2/2005 | McDonald |
| 2006/0099381 | A1 | 5/2006 | McDonald |
| 2007/0040036 | A1 | 2/2007 | Hallbauer et al. |
| 2007/0143170 | A1 | 6/2007 | Proch et al. |
| 2007/0152066 | A1 | 7/2007 | Colby et al. |
| 2008/0093425 | A1 | 4/2008 | McDonald |
| 2008/0149727 | A1 | 6/2008 | Boyd et al. |
| 2010/0007087 | A1 | 1/2010 | Pryke |
| 2011/0057032 | A1 | 3/2011 | Schultz et al. |
| 2011/0106697 | A1 | 5/2011 | Roberts et al. |
| 2012/0130892 | A1 | 5/2012 | Ronayne |

OTHER PUBLICATIONS

Notice of Allowance for U.S. Appl. No. 29/436,276, mailed May 22, 2013 (6 pages).

U.S. Appl. No. 13/368,989, filed on Feb. 8, 2012 (70 pages).

First Data, "GO-Tag™ Solution," http://www.firstdata.com, 2008, (2 pages).

Z-Format PocketMedia® Solutions for all market Sectors, http://www.zcard.com/pocketmedia/z-format.php, Admitted Prior Art (undated).

TRANSACTION PRODUCT ASSEMBLY WITH VEHICLE

BACKGROUND OF THE INVENTION

Stored-value cards and other transaction products come in many forms. A gift card, for example, is a type of transaction product that includes a pre-loaded or selectively loaded monetary value. In one example, a consumer buys a gift card having a specified value for presentation as a gift to another person. In another example, a consumer is offered a gift card as an incentive to make a purchase. A gift card, like other transaction products, can be "recharged" or "reloaded" at the direction of the bearer. The balance associated with the gift card declines as the gift card is used, which encourages repeat visits to the retailer or other provider issuing the gift card. Additionally, the gift card generally remains in the user's purse or wallet, serving as an advertisement or reminder to revisit the associated retailer. Gift cards and other transaction products provide a number of advantages to both the consumer and the retailer.

SUMMARY OF THE INVENTION

One aspect of the present invention relates to a transaction product assembly includes a transaction product and an auxiliary vehicle. The transaction product includes a folded sheet, wherein the folded sheet configured to be repeatedly folded and unfolded between a collapsed position and an extended position. The folded sheet defines a first substantially planar surface defining a printed track. The transaction product further comprises an account identifier statically connected thereto. The account identifier links the transaction product to at least one of an account and a record and is machine readable by a point-of-sale terminal. The auxiliary vehicle includes a microcontroller, one or more sensors, a motor, and at least one movable component. The microcontroller actuates the motor to induce movement of the at least one movable component in a manner propelling the auxiliary vehicle along and following the printed track based on detection of a location of the printed track as determined by the one or more sensors. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention.

A stored-value product or other transaction product is adapted to facilitate making purchases of goods and/or services at, for example, a retail store or website. According to one embodiment, an original consumer buys a transaction product to give a recipient who in turn is able to use it to pay for goods and/or services. A transaction product, according to embodiments of the present invention, alone or in combination with one or more auxiliary members, such as a vehicle and/or marker, provides the consumer and recipient with extra amusement and functionality in addition to the ability to pay for goods and/or services with the associated transaction product.

In particular, according to one embodiment, the transaction product assembly includes a transaction product and an auxiliary component such as an auxiliary vehicle. Transaction product has non-transactional functionality configured to interact with the auxiliary component. For example, a transaction product expands from a compact, substantially rectangular form factor to an expanded form factor defining at least one enlarged substantially planar surface. The enlarged substantially planar surface presents a track for the auxiliary vehicle to travel along. In one embodiment, the track is a two dimensional representation, and the auxiliary vehicle includes optical sensors and associated circuitry configured to detect the track and motorize movement of the auxiliary vehicle along the track. The auxiliary vehicle includes batteries, and in one embodiment, an on/off switch. Other types of article movement and/or control are also contemplated.

In one example, a writing utensil is provided or can otherwise be used to draw additional track lines that are detectable by the auxiliary vehicle such that the auxiliary vehicle moves along the drawn track in a manner similar to how the auxiliary vehicle moves along the initially provided track. In at least the manners described above, the transaction product provides amusing functionality in addition to transactional functionality.

Figure 1:
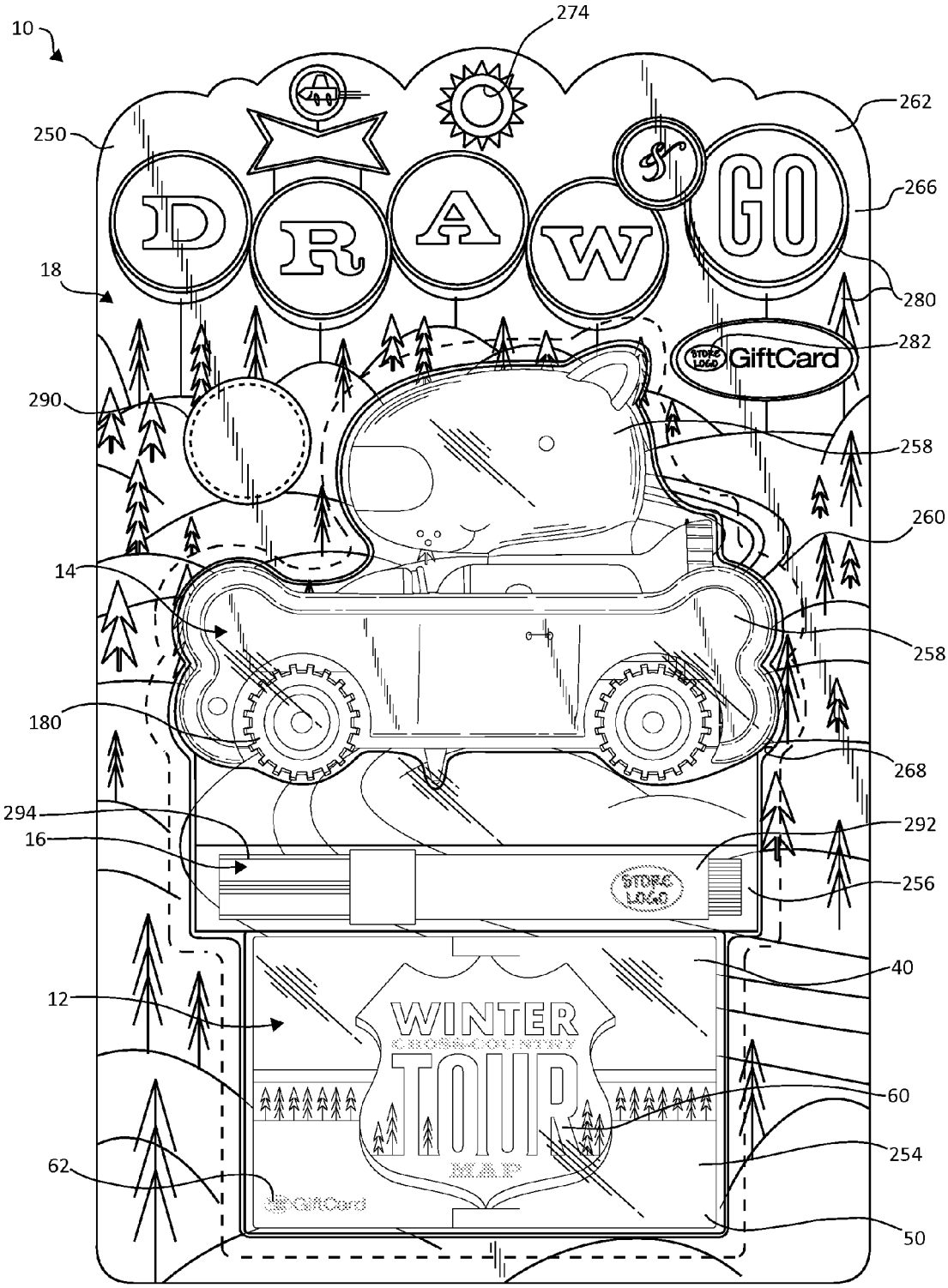
FIG. 1 is a front view illustration of a transaction product assembly, according to one embodiment of the present invention.
Figure 2:
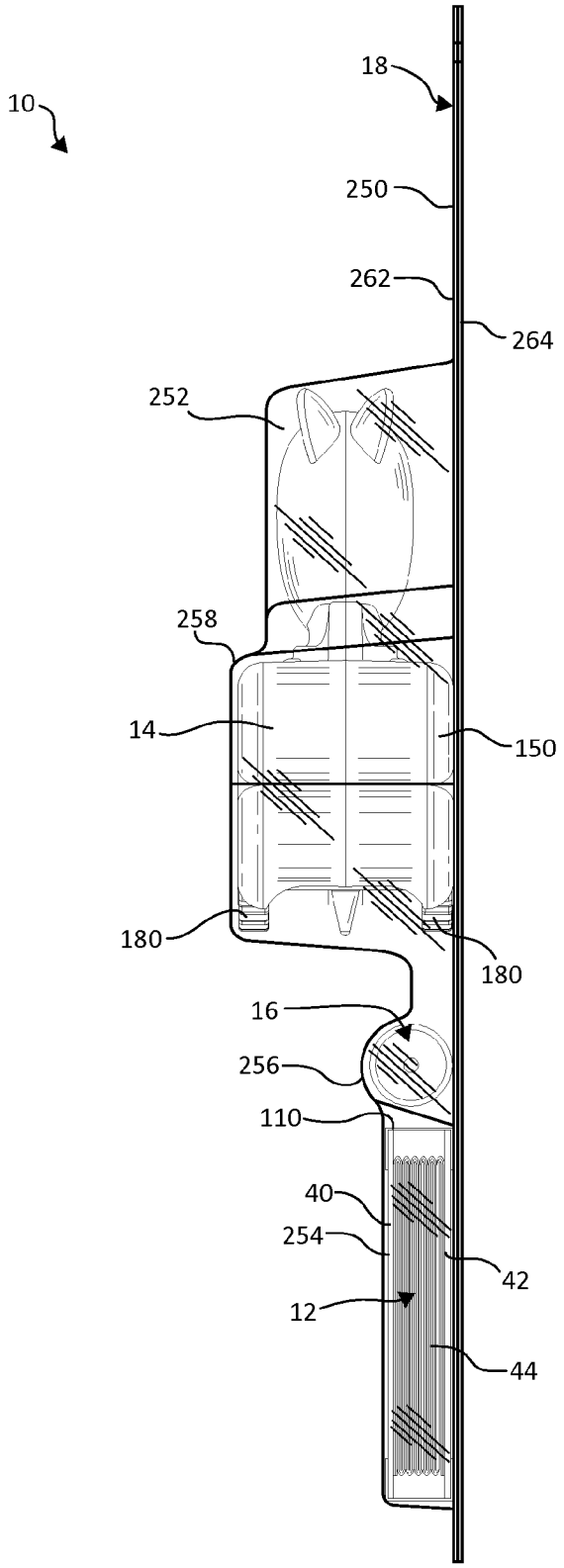
FIG. 2 is a right side view illustration of the transaction product assembly of FIG. 1, according to one embodiment of the present invention
Figure 3:
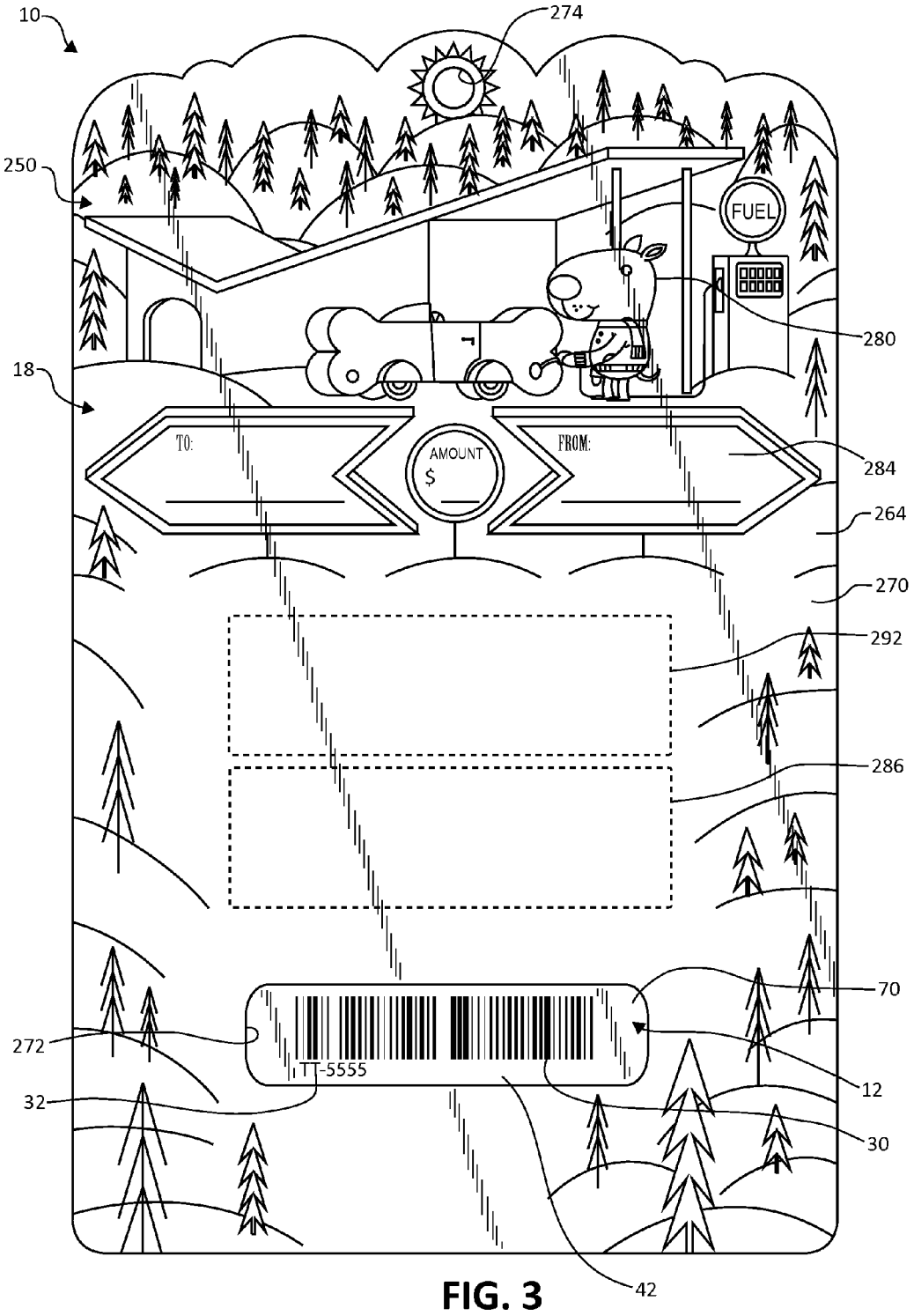
FIG. 3 is a rear view illustration of the transaction product assembly of FIG. 1, according to one embodiment of the present invention.
Figure 4:
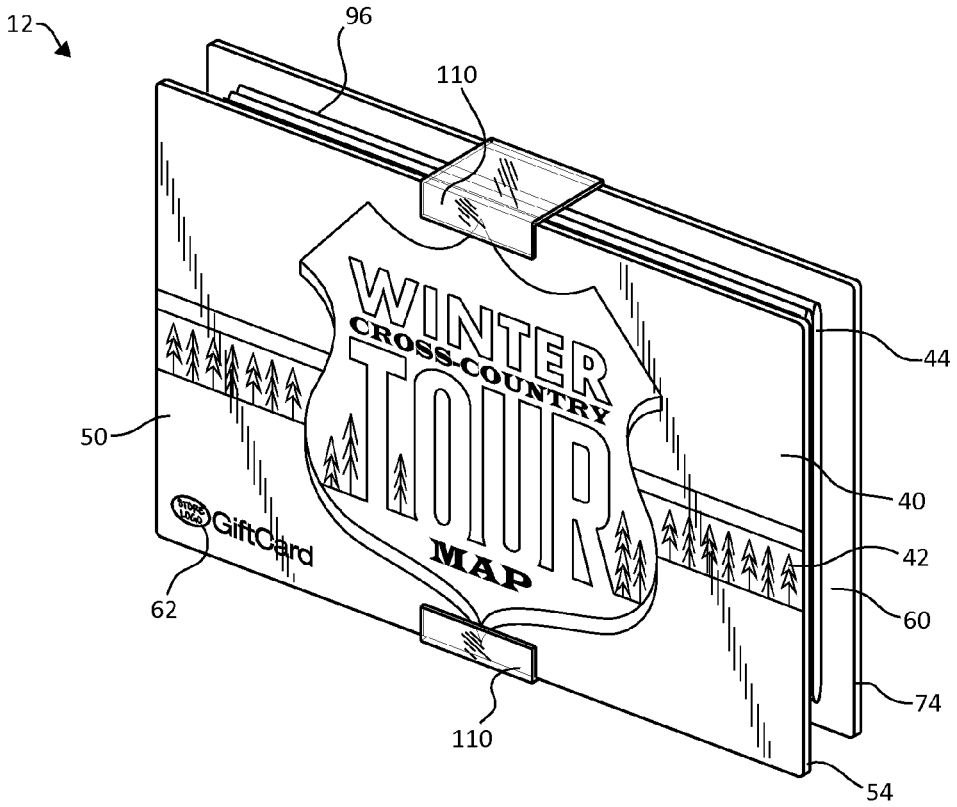
FIG. 4 is a top, front perspective view illustration of a transaction product of the transaction product assembly of FIG. 1 in a folded configuration, according to one embodiment of the present invention.

Turning to the figures, FIGS. 1-3 illustrate various views of one embodiment of a transaction product assembly 10 including a transaction product 12, a motorized article or auxiliary vehicle 14, a writing utensil 16, and a package 18. Transaction product 12 facilitates purchase of retail items and/or is configured to be applied toward use of pre-stored calling minutes, etc. and may be in the general form of a card (e.g., gift card, calling card, credit card, or debit card) or may take any other suitable form. In one embodiment, transaction product 12 is also configured to present a pathway or track 20 (e.g., FIG. 6) configured to direct associated movement of auxiliary vehicle 14 in an amusing or other non-transactional manner. Auxiliary vehicle 14 is any item having at least one moveable and motorized member (e.g., a wheel 180) configured to move along one or more tracks including track 20. Package 18 is configured to substantially enclose transaction product 12, auxiliary vehicle 14, and/or writing utensil 16 for transport and presentation in a retail store or related setting.

Figure 5:
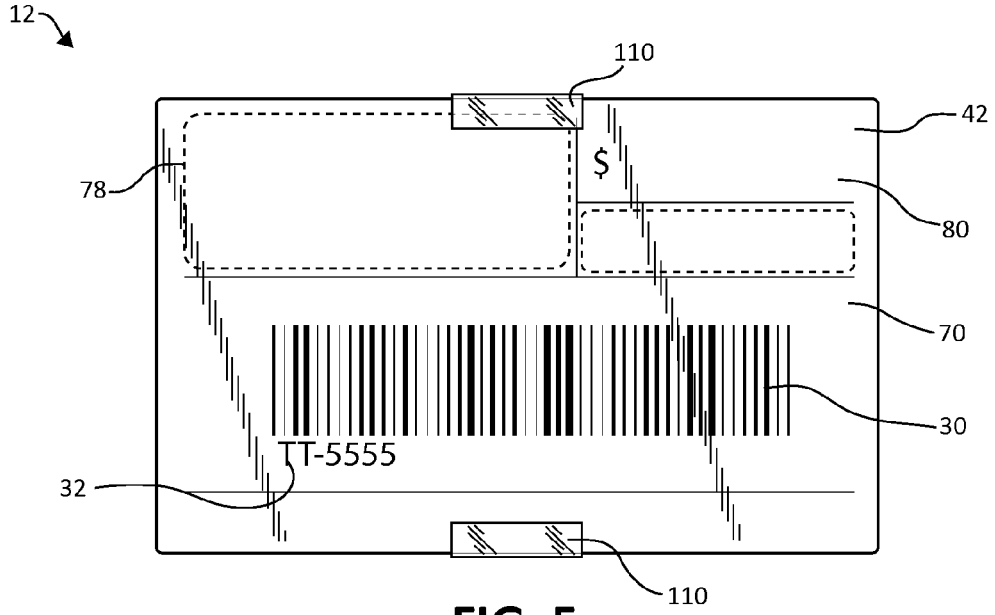
FIG. 5 is a rear view illustration of the transaction product of FIG. 4 in the folded configuration, according to one embodiment of the present invention.

FIGS. 4-7 collectively illustrate one example of transaction product 12. Referring to FIG. 5, for example, transaction product 12 includes at least one account activation area or account identifier 30, such as a bar code, magnetic strip, a smart chip or other electronic device, a radio frequency identification (RFID) device or other suitable identifier readily machine readable by a point-of-sale terminal or other account access station or kiosk. Account identifier 30 indicates an account or record to which transaction product 12 is linked. The account or record of the monetary or other balance on transaction product 12 optionally is maintained on a remote database accessible by corresponding point-of-sale terminals, other electronic or manual record-keeping system or, in the case of "smart" cards for example, on a chip or other electronic device(s) on transaction product 12 itself. Accordingly, by scanning account identifier 30, the account or record linked to transaction product 12 is identified and can subsequently be activated, have amounts debited therefrom, and/or have amounts added thereto.

In one embodiment, account identifier 30 includes a character string or code 32 (e.g., a number and/or letter string) configured to provide additional security to the user of transaction product 12 and/or configured to be read by a bearer of transaction product 12 to facilitate use of transaction product 12 for website or other purchases outside of brick-and-mortar type retail establishments. With the above in mind, account identifier 30 is one example of means for linking transaction product 12 with an account or record, and scanning of account identifier 30 is one example of means for activating or loading value on transaction product 12. Transaction product 12 is one example of means for supporting account identifier 30. Notably, although primarily described as including account identifier 30 on transaction product 12, in one embodiment, account identifier 30 is optionally included on auxiliary vehicle 14 in addition or as an alternative to transaction product 12.

In one embodiment, transaction product 12 includes a first cover panel 40 (i.e., top member), a second cover panel 42 (i.e. base member), and an intermediate member or sheet 44. First cover panel 40 comprises a single layer or multiple layers of paper or plastic material, for example, generally in the form of a relatively stiff but bendable/flexible card. Use of other materials is also contemplated. First cover panel 40 defines an outer surface 50 and an inner surface 52 (FIG. 6) with an outer perimeter 54 generally shared by outer surface 50 and inner surface 52. In one embodiment, one or both of outer surface 50 and inner surface 52 are substantially planar. In one example, outer perimeter 54 is substantially rectangular in shape, however other suitable outer perimeter shapes are equally acceptable.

In one embodiment, outer surface 50 includes additional indicia such as informative and/or decorative indicia 60 and/or brand indicia 62. In one example, decorative indicia 60 relate to a particular occasion, such as a wedding, new baby, graduation, holiday, season, brand identifier, media format identifier or other visual design to promote purchase of transaction product 12. In one example, decorative indicia 60 relate to content on intermediate sheet 44, as will be further described below, and/or may at least partially summarize or promote the content on intermediate sheet 44. Brand indicia 62 identify a brand associated with transaction product 12 such as identifying a product brand, a store brand, department, etc. In one example, brand indicia 62 identify a store or location configured to accept transaction product as payment toward a purchase of goods and/or services.

Second cover panel 42 comprises a single layer or multiple layers of paper or plastic material, for example, generally in the form of a relatively stiff but bendable/flexible card. Use of other materials is also contemplated. Second cover panel 42 defines an outer surface 70 and an inner surface 72 (FIG. 6) with an outer perimeter 74 generally shared by outer surface 70 and inner surface 72. In one embodiment, one or both of outer surface 70 and inner surface 72 is substantially planar. In one example, outer perimeter 74 is substantially rectangular in shape; however, other suitable outer perimeter shapes are equally acceptable. As illustrated, in one embodiment, first cover panel 40 and second cover panel 42 are formed of a similar material and have similarly sized and shaped outer perimeters 54 and 74 and, therefore, footprints.

In one embodiment, outer surface 70 includes various indicia, demarcations, or other features. In one example, outer surface 70 includes account identifier 30 and/or code 32 described above (e.g., FIG. 6). In one embodiment, account identifier 30 is located on a portion of transaction product 12 other than outer surface 70 of second cover panel 42, for example, on first cover panel 40 or intermediate sheet 44.

In one embodiment, redemption indicia 78 are included on transaction product 12, for example, on outside surface 70 of second cover panel 42. Redemption indicia 78 indicate that transaction product 12 is redeemable for the purchase of goods and/or services and that, upon use, a value of the purchased goods and/or services will be deducted from the financial account or record linked to transaction product 12. In one embodiment, redemption indicia 78 include phrases such as "<NAME OF STORE>GiftCard" and "This GiftCard is redeemable for merchandise or services at any of our stores or at our web site," and/or provides help or phone line information in case of a lost, stolen or damaged stored-value card, etc.

In one embodiment, outer surface 70 of second cover panel 42 or any other suitable portion of first cover panel 40 and second cover panel 42 includes gifting fields 80 or other personalization field configured to be written to by a consumer and/or retail store employee. In one embodiment, gifting fields 80 are positioned and configured to provide an area for the consumer or retail employee to write an amount or value added to transaction product 12 on initial activation and/or to whom transaction product 12 will be given to and whom it will be given from. It should be understood that other indicia may be included on first cover panel 40 and second cover panel 42, for example, instructional indicia, promotional indicia, additional decorative indicia, etc.

Intermediate sheet 44 is a substantially planar member made of one or more layers of any suitable paper, plastic, microfiber fabric, or composite material configured to be readily folded and unfolded a plurality of times without easily tearing or otherwise being substantially damaged. In one embodiment, intermediate sheet 44 is made out a material similar to that commonly used for foldable maps, etc. In one embodiment, intermediate sheet 44 is laminated or otherwise suitably treated to increase durability.

Intermediate sheet 44 defines a first surface 90 and a second surface 92 opposite first surface 90 and is divided into a plurality of sections 94, which, in one example, are all substantially similar in size, by a plurality of fold lines 96. In one example, fold lines 96 include lateral fold lines 96*a* and longitudinal fold lines 96*b*. When unfolded, intermediate sheet 44 is many times larger than either of first cover panel 40 and second cover panel 42 and, in one example, is at least about four times larger, for example, about twenty-four times larger or about fifty times larger than one of the plurality of sections 94. When fully folded about all fold lines 96, intermediate sheet 44 is configured to be the size (laterally and longitudinally) of one of the plurality of sections 94, but with an increased thickness. In one embodiment, each of the plurality of sections 94 is sized smaller than either first cover panel 40 and second cover panel 42. To facilitate substantially flat or planar positioning of unfolded intermediate sheet 44, in one example, some or all of the plurality of fold lines 96 are perforated so adjacent ones of the plurality of sections 94 unfolds to be more substantially planar with other adjacent ones of the plurality of sections 94.

In one embodiment, first surface 90 is configured to provide predefined track 20 (e.g., a printed track or pathway) configured for user interaction. More particularly, in one example, first surface 90 defines a serpentine track extending in a closed loop or otherwise between positions on intermediate sheet 44 marked as a start and a finish. In one example, second surface 92 includes a substantially blank space 98 and instructional indicia 100 instructing the user to draw their own track using writing utensil 16. In view of the above description, transaction product 12 is one example of means for providing a substantially planar path or track 20.

In one embodiment, other decorative indicia 104 are included to establish a surrounding for and/or to set a scene in combination with track 20. For example, in the illustrated embodiment, first surface 90 of intermediate sheet 44 provides track 20 in combination with decorative indicia 104 in a common winter activity theme. In one example, the winter activity theme corresponds with indicia 60 on outer surface 50 of first cover panel 40 of transaction product 12.

In one example, first surface 90 includes brand indicia 106 (FIG. 6), which identify a brand associated with transaction product 12 such as identifying a product brand, a store brand, department, etc. In one example, brand indicia 106 identify a store or location configured to accept transaction product 12 as payment toward a purchase of goods and/or services. By incorporating brand indicia 106, transaction product 12 serves as a continuous reminder and advertisement for the brand, store, department, etc. associated with transaction product 12 while the consumer interacts with transaction product for non-transactional purposes.

Figure 6:
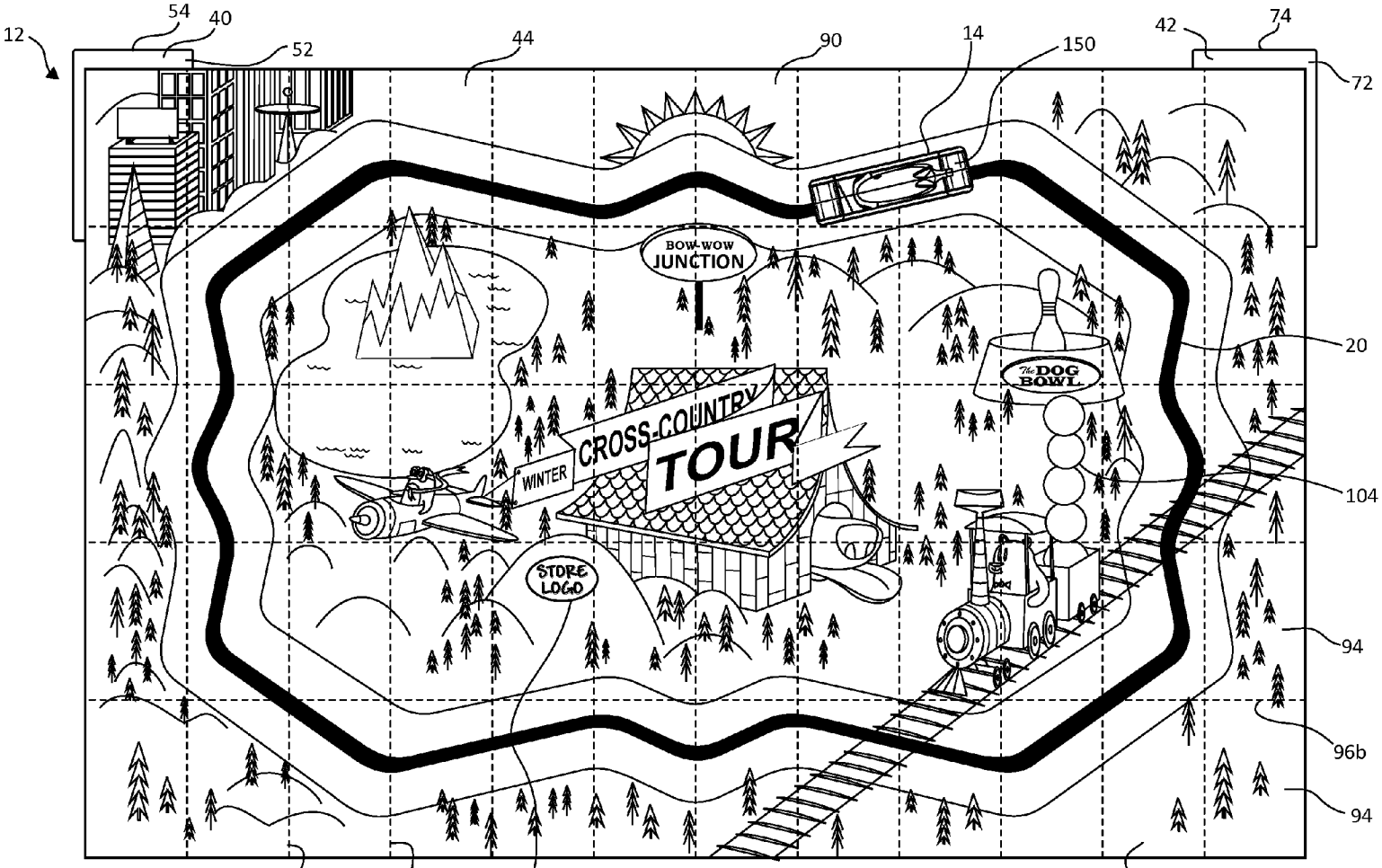
FIG. 6 is a first side view illustration of the transaction product of FIG. 4 in an unfolded configuration with the vehicle of FIG. 9, according to one embodiment of the present invention.
Figure 7:
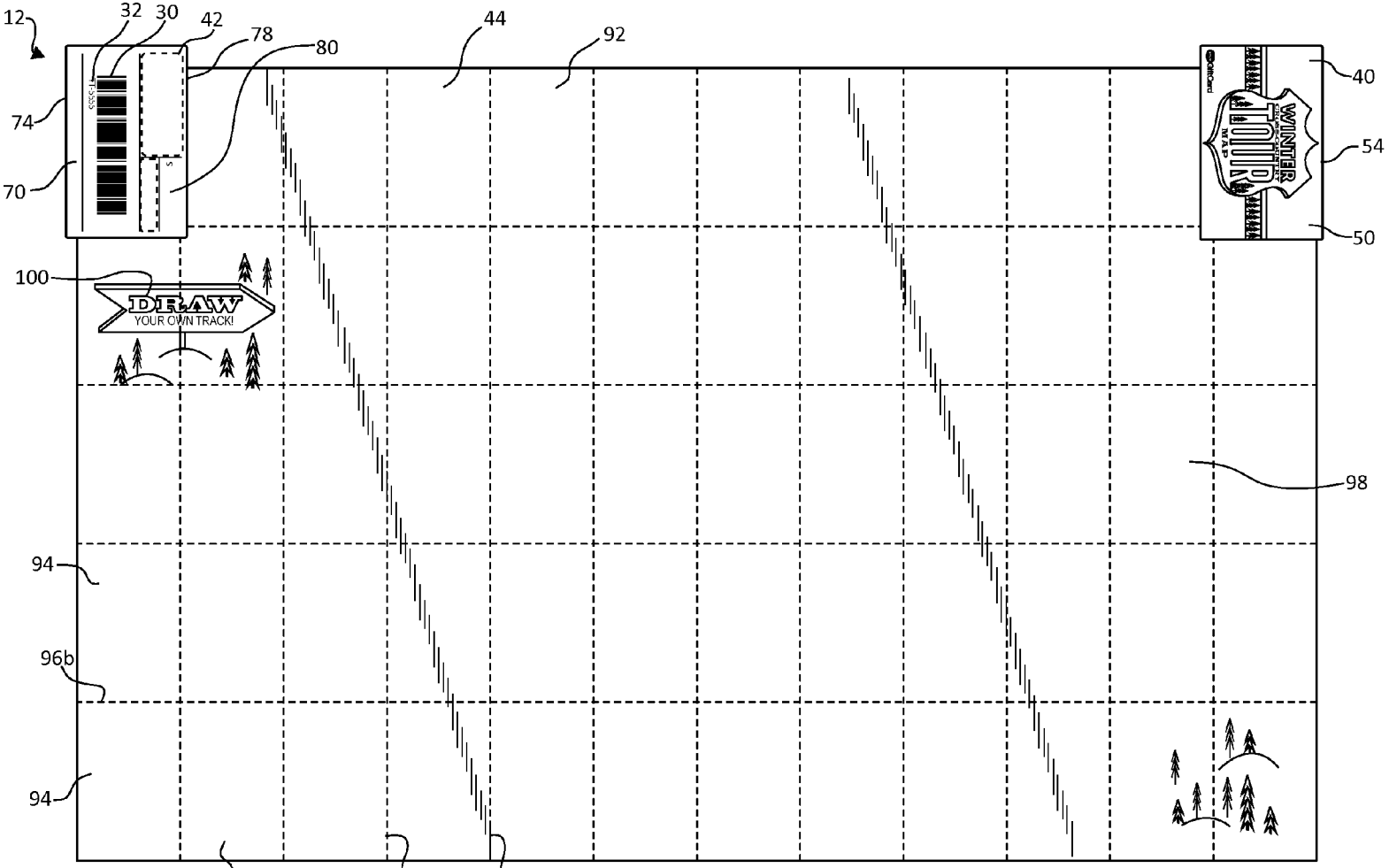
FIG. 7 is a second side view illustration of the transaction product of FIG. 4 in an unfolded configuration, according to one embodiment of the present invention.
Figure 8:
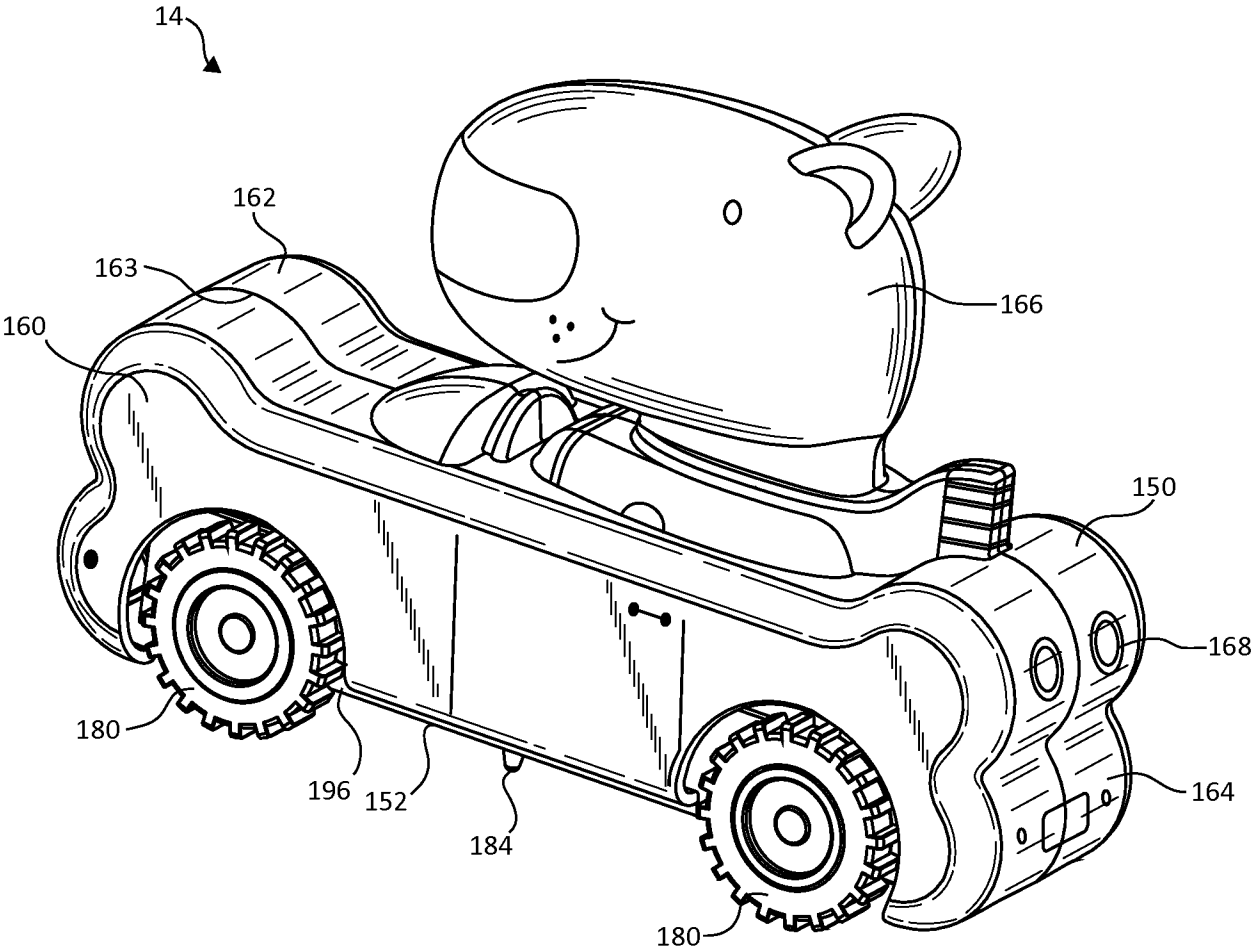
FIG. 8 is a top, front perspective view illustration of an auxiliary vehicle of the transaction product assembly of FIG. 1, according to one embodiment of the present invention.

First cover panel 40 and second cover panel 42 are coupled with intermediate sheet 44 at two different corners thereof, for example, adjacent or opposite corners, using adhesive. As illustrated in FIGS. 6 and 7, in one embodiment, inner surface 52 of first cover panel 40 is securely coupled to a portion of rear surface 72 defined by a corner one of the plurality of sections 94 of intermediate sheet 44, for example, the upper left corner of intermediate sheet 44 when first surface 90 of intermediate sheet 44 is viewed (e.g., as shown in FIG. 6). Inner surface 72 of second cover panel 40 is securely coupled to a portion of rear surface 72 defined by an opposite corner one of the plurality of sections 94 of intermediate sheet 44, for example, the upper right corner of intermediate sheet 44. In this embodiment, an even number of longitudinal fold lines 96*b* (e.g., four in the illustrated embodiment of FIGS. 6 and 7) are provided such that an odd number of sections 94 (e.g., five in the illustrated embodiment of FIGS. 6 and 7) are laterally formed along a width (i.e., the direction up and down in FIG. 6) of intermediate sheet 44. In one embodiment, an odd number of lateral fold lines 96*a* (e.g., eleven in the illustrated embodiment of FIGS. 6 and 7) are provided such that an even number of sections 94 (e.g., twelve in the illustrated embodiment of FIGS. 6 and 7) are longitudinally formed along a length (i.e., the direction side to side in FIGS. 6 and 7) of intermediate sheet 44. In one example, each of two of the respective corner ones of the plurality of sections 94 is centered relative to the respective first cover panel 40 and the second cover panel 42.

Once first cover panel 40 and second cover panel 42 are secured to intermediate sheet 44, intermediate sheet 44 is folded along fold lines 96. In particular, intermediate sheet 44 is first folded in an accordion fashion (i.e., in alternating directions about adjacent fold lines) or other suitable manner about longitudinal fold lines 96*b* to form an elongated member having a width substantially equal to a width of one section 94 and a length substantially equal to that of intermediate sheet 44. In this format, first cover panel 40 and second cover panel 42 face in opposite directions (i.e., one forward and one rearward).

Next, intermediate sheet 44 is folded along lateral fold lines 96*a*. More specifically, intermediate sheet 44 is folded along the one of lateral fold lines 96*a* adjacent first cover panel 40 such that first cover panel 40. In one embodiment, intermediate sheet 44 is then folded along others of longitudinal fold lines 96*b* in an accordion-style or other suitable manner until intermediate sheet 44 has been folded along all fold lines 96 and transaction product 12 is in the final folded or collapsed configuration.

In the final folded configuration, the overall width and length of folded intermediate sheet 44 is less than each of a width and a length of first cover panel 40 and second cover panel 42. As a result, intermediate sheet 44 is substantially hidden from view when transaction product 12 is viewed from either a front perspective or a rear perspective (e.g., FIG. 5). In one embodiment, tape, stickers, or other adhesive member(s) 110 each are applied to outer surface 50 of first cover panel 40, extend around a side edge of transaction product 12, and are applied to outer surface 70 of second cover panel 42 to maintain transaction product 12 in the fully folded or collapsed position until a consumer desires to unfold transaction product 12 and removes adhesive members 110.

In one embodiment, first cover panel 40 and second cover panel 42 provide relatively rigid top and bottom covers for intermediate sheet 44. In one embodiment, the additional rigidity and the larger size of first cover panel 40 and second cover panel 42 as compared to the size of the stack formed by the folded intermediate sheet 44 substantially protect intermediate sheet 44 from damage such as bent corners, rips, etc. when stored-value card 12 is in the folded or compact configuration.

In one embodiment, auxiliary vehicle 14 includes a cladding structure or enclosure 150 and a navigation and drive assembly 152. Enclosure 150 forms the exterior and adds pleasing aesthetics to auxiliary vehicle 14; while navigation and drive assembly 152 provides means for propelling auxiliary vehicle 14 along a surface and means for navigating along track 20. Enclosure 150 defines a cavity 154 having an opening 156, for example, a bottom opening as illustrated, for receiving navigation and drive assembly 152.

In one embodiment, enclosure 150, more particularly, is formed of a first side member 160 and a second side member 162 configured to form opposite sides of enclosure 150, which fit together along intersection line 163. First and second side members 160 and 162 are secured to one another in any suitable manner, for example, via friction fit, ultrasonic welding, rivets, screws, other fasteners, etc. In the illustrated embodiment, enclosure 150 defines a vehicle portion 164 and a driver portion 166. In one example, driver portion 166 depicts a character associated with one of a brand associated with stored-value card assembly 10 and/or a theme of stored-value card assembly 10, for instance, driver portion 166 is shaped and printed to present a mascot associated with a retail chain configured to accept stored-value card 12 as tender toward one or more of goods and services.

Enclosure 150 defines cavity 154 sized and shaped to snugly receive navigation and drive assembly 152 such that at least portions of navigation and drive assembly 152 are exposed via opening 156. In one embodiment, opening 156 defines two or more, for example, two, three, or four wheel wells 167 or other cutouts extending upwardly therefrom and configured to receive wheels 180 of navigation and drive assembly 152 as will be apparent to those of skill in the art upon reading the application. In one example, external surfaces of enclosure 150 include graphical indicia further defining portions of vehicle portions 164 and driver portion 166 and/or providing brand indicia or theme-related, decorative indicia 60 on stored-value card 12.

Figure 9:
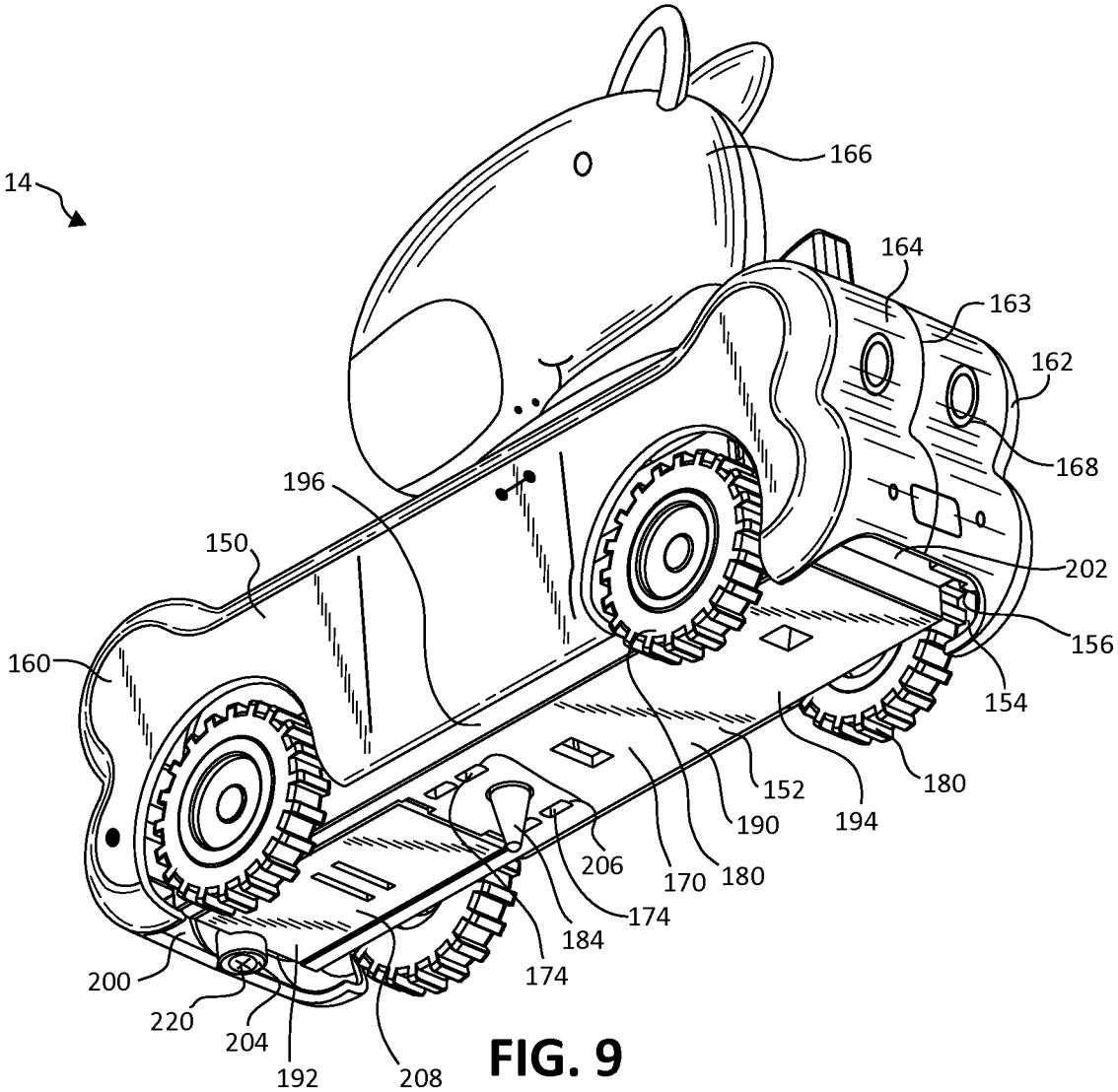
FIG. 9 is a bottom, front perspective view illustration of the auxiliary vehicle of FIG. 8, according to one embodiment of the present invention.
Figure 10:
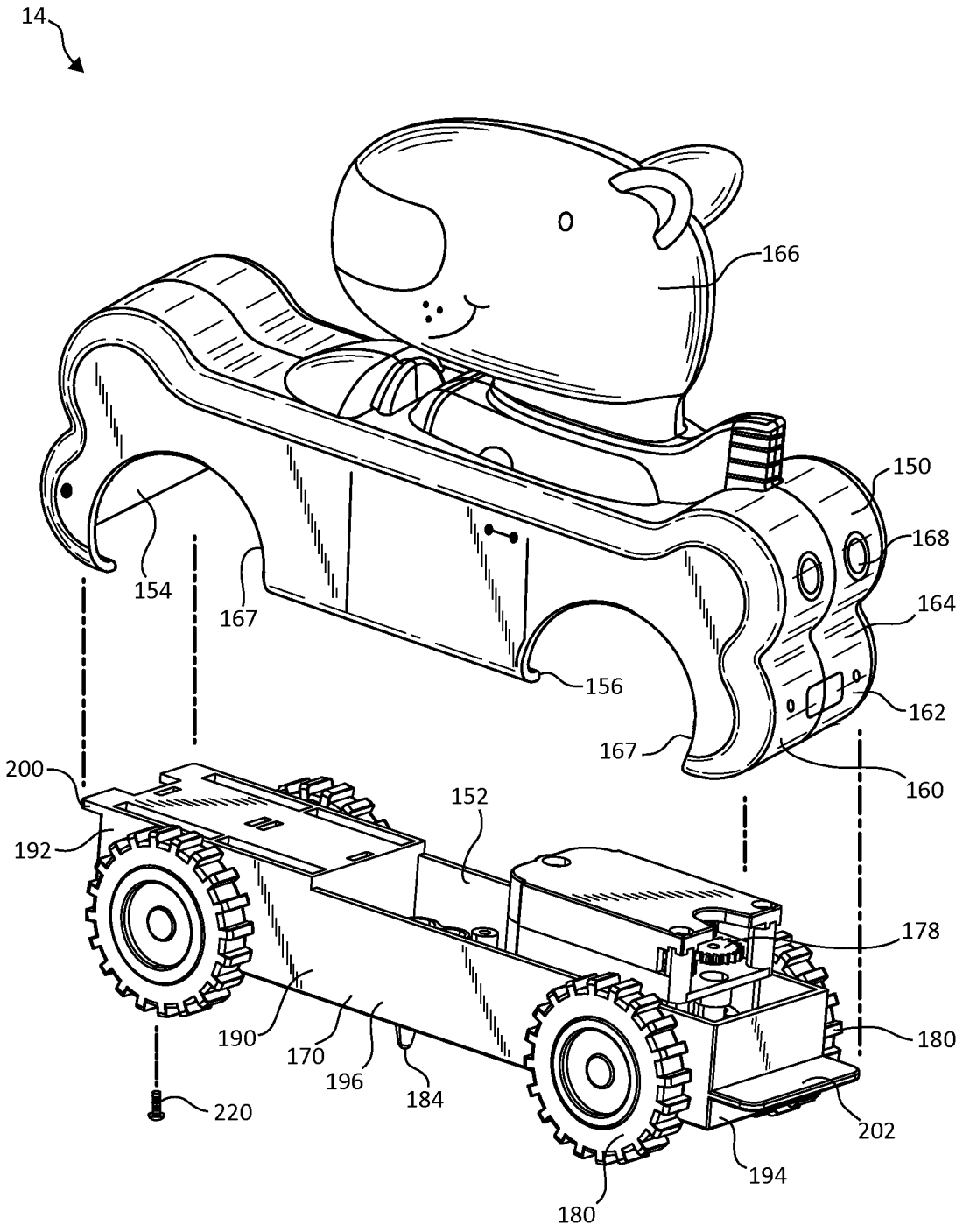
FIG. 10 is a top, front perspective and partially exploded view illustration of the auxiliary vehicle of FIG. 8, according to one embodiment of the present invention.
Figure 11:
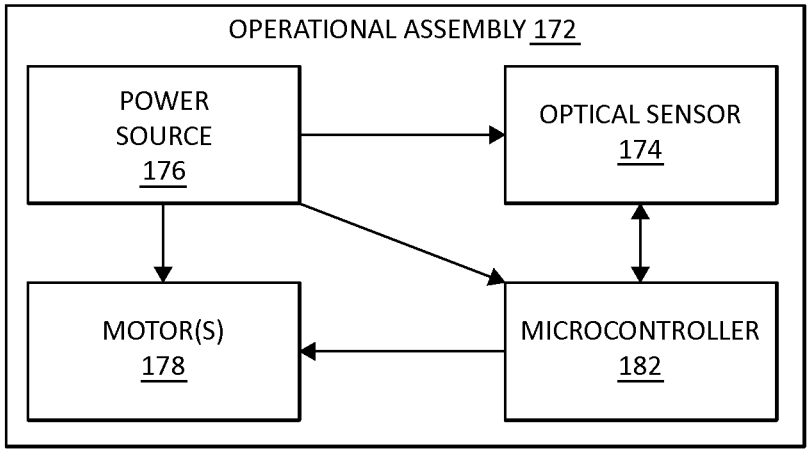
FIG. 11 is a schematic illustration of an operational assembly of the auxiliary vehicle of FIG. 8, according to one embodiment of the present invention.

Referring primarily to FIGS. 9-11, in one embodiment, navigation and drive assembly 152 includes housing 170, an operational assembly 172 substantially enclosed within or at least supported by housing 170, wheels 180 (e.g., two, three, or four wheels) extending from housing 170 via axles (not shown). Operational assembly 172 is configured to detect a position of track 20 under auxiliary vehicle 14 as auxiliary vehicle 14 is driven to move along track 20, and to steer auxiliary vehicle 14 to turn with track 20. For example, operational assembly 172 includes a one or more photosensors or optical sensors 174 or other suitable sensor(s) (e.g., magnetic sensors where track 20 is magnetized) configured to detect placement of track 20 on intermediate sheet 44 of stored-value product 12, power source 176, one or more drive motors 178, and a microprocessor or microcontroller 182, according to one embodiment of the present invention. Power source 176 in one example, includes batteries, and is configured to power the other components of operational assembly 172.

In one embodiment, optical sensor 174 faces downwardly and extends through housing 170 and/or is directed toward and, in one example, through a lower opening 206 in enclosure 150. More particularly, facing downwardly toward track 20 (FIG. 6), the one or more optical sensors 174 are configured to detect reflected light from track 20 and surrounding portions of intermediate sheet 44. That is, when the one or more optical sensors is/are positioned over track 20, which is generally black or otherwise solid, opaque, and dark in nature, the one or more optical sensors 174 do not generally detect light. If track 20 begins to curve as auxiliary vehicle 14 moves forwardly (or rearwardly), the one or more optical sensors 174 begin to detect a white signal from areas of intermediate sheet 44 immediately adjacent track 20. Depending upon the position of the optical sensors 174 change of detection of a white signal to a black signal or vice versa via the one or more optical sensors 17 causes microcontroller 182 in communication therewith to direct the one or more drive motors 178 to induce movement of wheels 180 and, therefore, movement of auxiliary vehicle 14 and to steer auxiliary vehicle 14.

In one embodiment, auxiliary vehicle 14 is steered by turning one, two, all, or a portion of wheels 180 in combination. In another embodiment, auxiliary vehicle 14 is steered by impeding rotation of one or more of the wheels in a manner causing auxiliary vehicle 14 to turn. More specifically, in one embodiment, auxiliary vehicle 14 includes a rotatable cone or rotatable peg 184 extending downwardly from housing 170 centered between wheels 180 to skim track 20 below. When movement of one of wheels 180 is impeded, auxiliary vehicle 14 pivots around rotatable peg 184 on track 20 to correct the course (i.e., turn) auxiliary vehicle 14.

More specifically, in one embodiment, as illustrated in FIG. 9, one of optical sensors 174 is positioned toward a right side of auxiliary vehicle 14 and the other is positioned toward a left side of auxiliary vehicle 14 to straddle track 80. In this configuration, each operational assembly 172 is preset to continue forward in a straight line until one of optical sensors 174 detects "black," that is, an edge of track 20. If one of optical sensors 174 detects "black," a signal is sent from microcontroller 182 to the one or more drive motors 178 to change the drive on one of the wheels resulting in a slight turn and correction of auxiliary vehicle 14 to keep auxiliary vehicle 14 traveling along track 20. In other embodiments, such as where a single optical sensor 174 is centered on auxiliary vehicle 14, operational assembly 172 is preset to continue forward in straight line movement until the one optical sensors 174 detects "white," at which time a correction of drive of one of wheels 180 is initiated. In view of the above description, one or more optical sensors 174 are examples of means for detecting whether movement of auxiliary vehicle 14 follows track 20, and operational assembly 172, namely microcontroller 182 and one or more drive motors 178, are examples of means for adjusting movement of auxiliary vehicle 14 when it is determined that auxiliary vehicle 14 is not following track 20.

The one or more optical sensors 174 are, in one example, in the form of multipixel CCD or CMOS imagers and or includes a simple pair of photodetectors in the form of any suitable photosenstive sensor. Examples of suitable optical sensors 174 include, but are not limited to, photodiodes, photoresistors, and phototransistors. Drive motors 178 are any suitable motor configured to turn axels of one or more of wheels 180 collectively and/or independently, and to control steering of wheels 180, for example, by independent rotation control of one or more of wheels 180. Depending upon cost constraints when building auxiliary vehicle 14, in one embodiment, auxiliary vehicle additionally includes lights (not shown), such as LEDs that provide a source of light that supplies the reflections off of track 20 and surrounding area. Examples of suitable vehicles with optical sensors include, but are not limited to those recited in U.S. Pat. No. 6,695,668, issued Feb. 24, 2004 and filed Jan. 29, 2002, the contents of which are incorporated by reference herein Housing 170, according to one embodiment, includes a primary body or elongated primary body 190 portion as illustrated for example in FIG. 10. As illustrated, primary body 190 includes a front 192, a rear 194, and two opposing sidewalls 196. A front flange 200 extends forwardly from front 192, and a rear flange 194 extends rearwardly extends from rear 194. Each of front flange 200 and rear flange 202 are configured to interface with opening 156 or other lip (not shown) near opening in housing 150 to help maintain housing 170 of navigation and drive assembly substantially entirely within cavity 154 of housing 150. According to one embodiment, a threaded cavity 204 extends through housing 150 and is configured to facilitate coupling housing 150 with navigation and drive assembly 152 using a fastener 220, such as a screw, rivet, or other suitable fastener.

Drive motor(s) 178, microcontroller 182, power source 176, e.g., one or more batteries, and optical sensor 174 are substantially maintained within, supported by, and/or extend from housing 170 of navigation and drive assembly 152. In one embodiment, an opening 206 is defined in a bottom surface of housing 170 to allow optical sensor 174 to be directed toward track 20 and generally a surface below auxiliary vehicle 14. In one embodiment, housing 170 additionally includes a battery cover plate 208 extending across an opening (not shown) to a cavity (not shown) in housing 170 configured to selectively maintain power source 176, e.g., one or more batteries, within and electrically couple power source 176 to other components of navigation and drive assembly 152. Other embodiments of navigation and drive assembly 152 will be apparent to those of skill in the art upon reading this application. In view of the above description, auxiliary vehicle 14 is one example of means for mechanically moving along track 20.

Transaction product 12 and auxiliary vehicle 14 are packaged with one another for retail display in any suitable manner. One example of package 18 is illustrated in FIGS. 1-3. As illustrated, in one embodiment, package 18 includes a support card 250 or backer and a clamshell 252. Clamshell 252 is configured to receive transaction product 12, auxiliary vehicle 14, and writing utensil 16 within corresponding portions thereof such as a transaction product portion 254, a writing utensil portion 256, and a vehicle portion 258. Each of clamshell portions 254, 256, and 258 defines a cavity or wells sized similarly to and slightly larger than an overall size and shape of the one of transaction product 12, auxiliary vehicle 14, and writing utensil 16 it is configured to receive. Clamshell portions 254, 256, and 258 surrounded by a perimeter flange or frame 260 (shown in dashed, hidden lines in FIG. 1 through a portion of support panel 250) in a substantially planar manner. In one embodiment, clamshell 252 is thermoformed or otherwise suitably formed from a single homogenous sheet of a suitable plastic. Clamshell 252 is substantially transparent (e.g., is transparent or translucent), according to one embodiment.

In one example, support card 250 includes a front layer 262 and a rear layer 264. Front layer 262 and rear layer 264 are both substantially planar and may be formed as separate pieces or as a single piece folded at or near an intersection between front layer 262 and rear layer 264. Front layer 262 and rear layer 264 are formed of any suitable supporting material such as paperboard, chipboard, cardboard, plastic sheeting, etc. In one example, front layer 262 defines a front substantially planar surface 266 of package 18 as viewed during retail display and rear layer 264 defines the rear of package 18. In one embodiment, first panel 262 defines a clamshell-receiving aperture 268. Clamshell-receiving aperture 268 is configured to receive clamshell 252 such that transaction product portion 254, writing utensil portion 256, and vehicle portion 258 of clamshell 252 substantially extend in front of front layer 262 while frame 260 of clamshell 252 remains substantially entirely behind front layer 262.

In one embodiment, rear layer 264 defines a rear substantially planar surface 270 includes an activation aperture 272. Activation aperture 272 is any suitable size to provide access to account identifier 30 of transaction product 12 upon final assembly of package 18. In one embodiment, one or both of front layer 262 and rear layer 264 defines a hanging aperture 274 to facilitate hanging of transaction product assembly 10 for retail display.

Upon assembly, clamshell 252 is placed in clamshell-receiving aperture 268 of front layer 262 and transaction product 12 is placed in transaction product portion 254 of clamshell 252 such that outside surface 50 of first cover panel 40 faces forwardly (i.e., away from support panel 250). In one embodiment, transaction product 12 fits entirely within transaction product portion 254 of clamshell 252. Writing utensil 16, which in one embodiment is a marker having a thick enough writing tip (not shown) to be used to draw additional tracks (not shown) that auxiliary vehicle 14 may be able to follow along using optical sensor 176, is placed in writing utensil portion 256 of clamshell 252. In view of the above description, writing utensil 16 is one example of means for drawing a track. Finally, auxiliary vehicle 14 is placed in vehicle portion 258 of clamshell 252. In one embodiment, each of transaction product 12, writing utensil 16, and transaction product 12 are configured to be substantially entirely maintained in cavities formed within each of transaction product portion 254, writing utensil portion 256, and vehicle portion 258 of claim shell 252, respectively.

A front surface (not shown) of rear layer 264 is aligned with and coupled to, e.g., adhered to, a rear surface (not shown) of front layer 262. When front layer 262 and rear layer 264 are aligned, activation aperture 272 aligns with transaction product 12 such that account identifier 30 and/or activation code 32 on transaction product 12 is/are visible through activation aperture 272 as illustrated in FIG. 2.

In one embodiment, package 18 includes displays, indicia, graphics or text information including store logo(s), store name(s), slogans, advertising, instructions, directions, brand indicia, promotional information, holiday indicia, seasonal indicia, media format identifiers, characters and/or other information on external surfaces of front layer 262 and rear layer 264 (i.e., front substantially planar surface 266 of front layer 262 and rear substantially planar surface 270 rear surface of rear layer 264).

For example, in one embodiment, support card 250 includes decorative indicia 280, which makes package 18 more aesthetically pleasing to potential consumers, and also, in one example, ties package 18 to the overall appearance of transaction product 12 and auxiliary vehicle 14. For instance, decorative indicia 280 provide background scenery or other related graphics to a common theme of auxiliary vehicle 14 and transaction product 12.

In one embodiment, support card 250 includes brand indicia 282, which identify a store, brand, department, etc. and/or services associated with transaction product 12. In one example, support card 250 includes indicia 284 including to, from, and amount fields. The fields of indicia 284 provide areas of support card 250 configured to be written upon by a consumer to personalize support card 250 for presentation as a gift to a particular recipient, for a particular purpose, and/or to indicate a value of transaction product 12.

In one embodiment, support card 250 includes redemption indicia 286, generally indicated by a dashed box in FIG. 2, indicating that transaction product 12 is redeemable for the purchase of goods and/or services and that upon use, a value of the purchased goods and/or services will be deducted from the financial account or record linked to transaction product 12. In one embodiment, redemption indicia 286 include phrases such as "<NAME OF STORE> GiftCard" and "This GiftCard is redeemable for merchandise or services at any of our stores or at our website," and/or provides help or phone line information in case of a lost, stolen, or damaged transaction product, etc.

As illustrated in FIGS. 1 and 2, in one example, support card 250 includes promotional and/or instructional indicia 290 (generally indicated with dashed circles or boxes in FIGS. 1 and 2) advertising the non-transactional or amusing functionality of transaction product 12 and providing instructions for both transactional and non-transactional (i.e., amusing) interaction with components of transaction product assembly 10. In one embodiment, promotional indicia 290 generally indicate to a bearer of transaction product assembly 10 that upon placement of auxiliary vehicle 14 and activation thereof (e.g., via an on/off switch) on track 20, auxiliary vehicle 14 will move along track 20 in a self-motivated manner. As such, promotional indicia 290 further promotes the sale of transaction product assembly 10 by drawing the attention of a potential consumer to the non-transactional and amusing feature(s) of transaction product assembly 10.

Any of indicia 60, 62, 282, 284, 286, 290, etc. account identifier 30, and/or other indicia optionally may appear anywhere on support card 250 or transaction product 12. Additional information besides that specifically described and illustrated herein may also be included and/or one or more of indicia 60, 62, 280, 282, 284, 286, and 290 may be eliminated.

Upon assembly, components of transaction product assembly 10 function to both amuse consumers and/or recipients and to entice consumers to purchase transaction product assembly 10. In particular, consumers are encouraged to purchase transaction product assembly 10 due to its entertainment value in addition to its transactional functionality. In particular, in one embodiment, transaction product assembly 10 provides auxiliary vehicle 14 and track 20 for auxiliary vehicle 14 to travel upon. For instance, when folded substantially flat, intermediate sheet 44 provides track 20 such that auxiliary vehicle 14 optically or otherwise suitably interacts with and moves along track 20. In the illustrated embodiments, intermediate sheet 44 additionally includes a substantially blank second surface 92 providing space for a user to draw her own track (not shown) using writing utensil 16 or other suitable writing utensil. Other various tracks may be provided using intermediate sheet 44 as will be apparent to those of skill in the art upon reading the present application. In addition, in one embodiment, a use can draw other tracks on other planar surfaces (not shown) using writing utensil 16 or other writing instrument.

Figure 12:
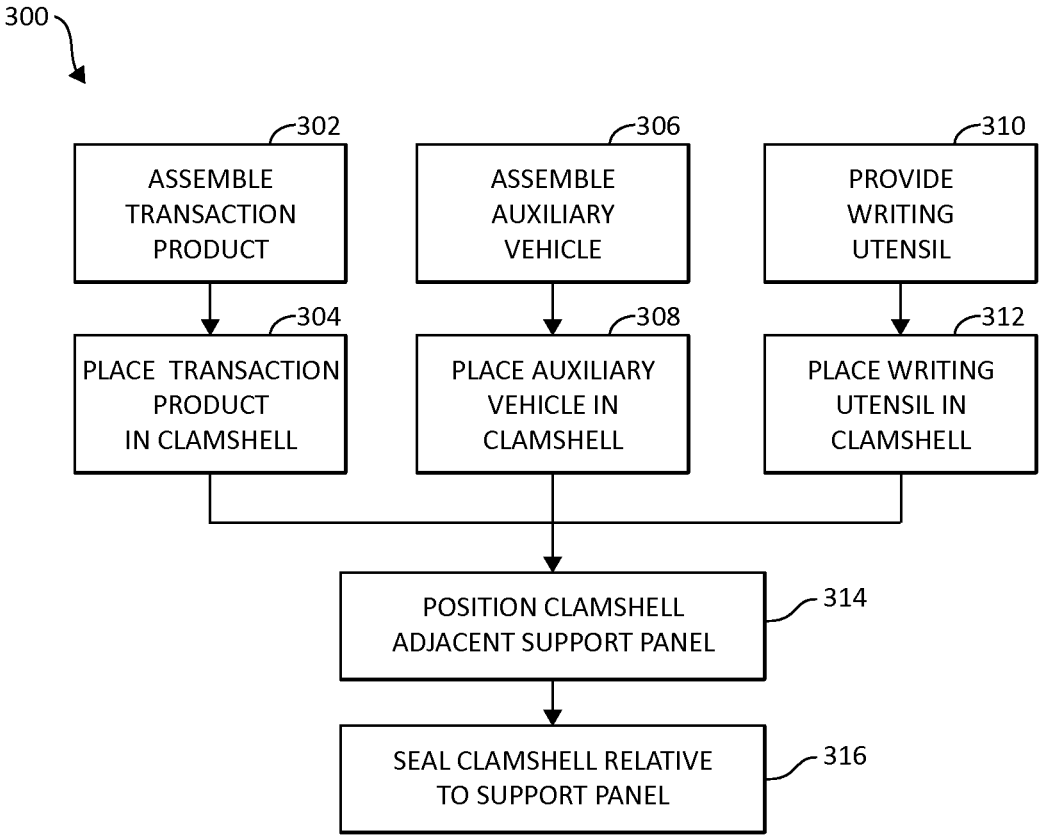
FIG. 12 is a flow chart illustrating a method of assembling a transaction product assembly, according to one embodiment of the present invention.

FIG. 12 is a flow chart illustrating one embodiment of a method 300 of assembling transaction product assembly 10. At 302, transaction product 12 is assembled. For example, first cover panel 40 and second cover panel 42 are and are each coupled to a different corner one of the plurality of sections 94 of intermediate sheet 44, more specifically, to second surface 92 of intermediate sheet 44. In one embodiment, first cover panel 40 and second cover panel 42 are each coupled to portions of second surface 92 of intermediate sheet 44 such that the corresponding corner one of the plurality of sections 94 is centered relative to the respective one of first cover panel 40 and second cover panel 42. Then, intermediate sheet 44 is folded about fold lines 96 (e.g., along longitudinal fold lines 96*b* first then along lateral fold lines 96*a* in an accordion-like style) into a folded stack of sections 94, and first cover panel 40 and second cover panel 42 are secured to one another to remain in a folded or compacted position. In one example, transparent or translucent stickers 110 are applied to and extend between first cover panel 40 and second cover panel 42 to prevent inadvertent unfolding or expansion of transaction product 12, more particularly, intermediate sheet 44.

Although described above as folding intermediate sheet 44 after first cover panel 40 and second cover panel 42 have been attached thereto, in one embodiment, first cover panel 40 and second cover panel 42 are coupled to opposing corner ones of the plurality of sections 94 of intermediate sheet 44 when intermediate sheet 44 is folded. When transaction product 12 is assembled, outer surfaces 30 and 52 of first cover panel 40 and second cover panel 42, respectively, face outwardly away from one another and a remainder of transaction product 12. Once transaction product 12 is assembled it is placed within clamshell 252, more particularly, within transaction product portion 254 of clamshell 252 at 304.

At 306, auxiliary vehicle 14 is assembled. More particularly, navigation and drive assembly 152 is assembled by placing the various components of operational assembly 172 within corresponding portions of housing 170 and in electrical and/or mechanical communication with one another in a manner configured to be powered by power source 176, controlled by microcontroller 182, driven by one or more motors 178, and informed regarding track 20 by optical sensor 174. Once navigation and drive assembly 152 is assembled, housing 170 is secured within housing 150, more particularly, cavity 154. For example, housing 170 is slid into cavity 154 via opening 156 such that front and rear flanges 200 and 202 of housing 170 push beyond and effectively lock on opposing sides of enclosure 150 in cavity 154. In one embodiment, one or more fasteners 220 are secured through each of housing 170 and enclosure 150 to further secure navigation and drive assembly 152 within housing 150. Once auxiliary vehicle 14 is assembled, optical sensor 174 points downwardly, and in one embodiment, extends downwardly in the same general direction wheels 180 extend downwardly from housing 170 and auxiliary vehicle 14 is placed in vehicle portion 258 of clamshell 152 at 308.

At 310, writing utensil 16 is provided. Writing utensil 16 is any suitable writing tool configured to substantially reliably write a sufficiently thick line that is detectable by optical sensor 174 such that auxiliary vehicle 14 will automatically travel along most tracks drawn with writing utensil 16 provided such drawn tracks provide sufficient turning radii for auxiliary vehicle 14 to maneuver along. In one embodiment, writing utensil 16 is a marker with a primary shaft 292 and cover 294 (FIG. 1); however, other writing utensils 16 are also contemplated. Once provided, writing utensil 16 is placed in writing utensil portion 256 of clamshell 252 at 312. In one embodiment, writing utensil 16 is eliminated from transaction product assembly 10 and steps 310 and 312 are eliminated.

Once transaction product 12, auxiliary vehicle 14, and in one example, writing utensil 16 are placed in clamshell 252 at 304, 308, and 312, then, at 314, clamshell 252 is placed relative to front layer 262 of support panel 250, e.g., such that clamshell portions 254, 256, and 258 extend through clamshell-receiving aperture 268 and frame 260 is placed adjacent a rear surface (not shown) of front layer 262. In other embodiments, multiple clamshells are used to retain transaction product 12, writing utensil 16, and auxiliary vehicle 14 instead of one clamshell 252 with various portions 254, 256, and 258. Although operation 314 is described here and illustrated in FIG. 12 as occurring after operations 304, 308, and 312, in other embodiments operation 314 occurs before operations 304, 308, and 312.

Finally, at 316, rear layer 264 of support panel 250 is secured to e.g., adhered to front layer 262 of support panel 250 thereby securing frame 260 of clamshell 252 therebetween and aligning account identifier 30 of transaction product 10 with activation aperture 272 of rear layer 264. In other embodiments, support panel 250 is provided as a single layer, clamshell-receiving aperture 268 is eliminated, and frame 260 is secured directly to substantially planar front surface 266 of support panel 250. In either embodiment, transaction product 10, writing utensil 16, and auxiliary vehicle 14 are secured within clamshell 152 between clamshell 152 and support panel 250. Once assembled, transaction product assembly 10 is ready for shipment to and placement within retail stores.

Figure 13:
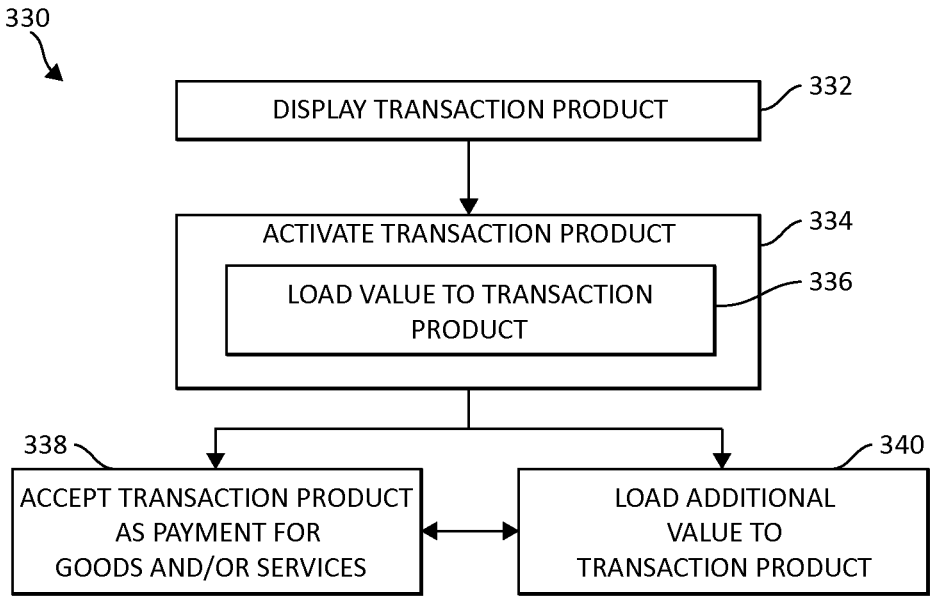
FIG. 13 is a flow chart illustrating a method of encouraging purchase and facilitating use of a transaction product assembly, according to one embodiment of the present invention.

FIG. 13 is a flow chart illustrating one embodiment of a method 330 of encouraging purchase and facilitating use of transaction product assembly 10 by consumers and/or recipients. At 332, transaction product assembly 10 is placed on or hung from a rack, shelf, or other similar device to display transaction product assembly 10, and therefore, transaction product 12, for sale to potential consumers. In one embodiment, a depiction of transaction product 12 and/or transaction product assembly 10 is additionally or alternatively placed on a website for viewing and purchase by potential consumers.

At 334, a consumer who has decided to purchase transaction product assembly 10 presents transaction product assembly 10 to a retail store employee, retail store kiosk, remote terminal, or other person or device to scan account identifier 30 using a point-of-sale terminal or other machine to access an account or record linked to account identifier 30. Notably, as used herein "purchase" of transaction product assembly 10 does not require a fee or other dollar amount to be paid for transaction product 12 or associated components, but rather that transaction product 12 is being activated and funds placed in the associated account or record. In one example, purchase of transaction product assembly 10 does require a fee to be paid to the retail store or setting. In particular, account identifier 30 is scanned or otherwise accessed, for example through access opening 272 of support panel 250 to activate transaction product assembly 10, more particularly, transaction product 12 and the remote, database stored account or record linked thereto. Upon accessing the account or record, then, at 336, value is added to the account or record in the form of monetary value, points, minutes, etc. Thus, transaction product 12 is activated and loaded for future use toward a purchase or use of goods and/or services.

In one example, a predetermined value is associated with transaction product 12 (i.e., associated with the account or record linked to transaction product 12 via account identifier 30) prior to activation and display, but such predetermined value is not initially available for use toward the purchase or use of goods and/or services. In such an embodiment, at 334, transaction product 12 is activated to permit subsequent access to the predetermined value (e.g., subsequent loading on and debiting from the account or record) and no additional value is added during activation such that operation 306 may be eliminated.

Once transaction product 12 is activated and loaded, transaction product 12 can be used by the consumer or any other bearer of transaction product 12 to purchase goods and/or services at the affiliated retail setting (e.g., a retail store or website) or can be used in exchange for calling minutes, etc. In one embodiment, where transaction product 12 is displayed on a website at 332, then, at 334, transaction product 12 may be activated in any suitable method and may not require the physical scanning of account identifier 30 to be activated or to otherwise access the associated account or record such as at 336.

In one example, at 338, the retail store or other affiliated retail setting or website accepts transaction product 12, or more precisely, value in the account or record linked to transaction product 12 via account identifier 30, as payment toward the purchase of goods and/or services made by the current bearer of transaction product 12. In particular, the value currently loaded on transaction product 12 (i.e., stored or recorded in the account or record linked to account identifier 30) is applied toward the purchase of goods and/or services. At 340, additional value is optionally loaded on transaction product 12 at a point-of-sale terminal, kiosk or other area of the retail store or related setting using account identifier 30. Upon accepting transaction product 12 as payment at 338, the retail store or related setting can subsequently perform either operation 338 or operation 340 as requested by a current bearer of transaction product 12. Similarly, upon loading additional value on transaction product 12 at 340, the retail store or related setting can subsequently perform either operation 340 again or operation 338. In one example, the ability to accept transaction product 12 as payment for goods and/or services is limited by whether the account or record associated with transaction product 12 has any value stored or recorded therein at the time of attempted redemption.

Figure 14:
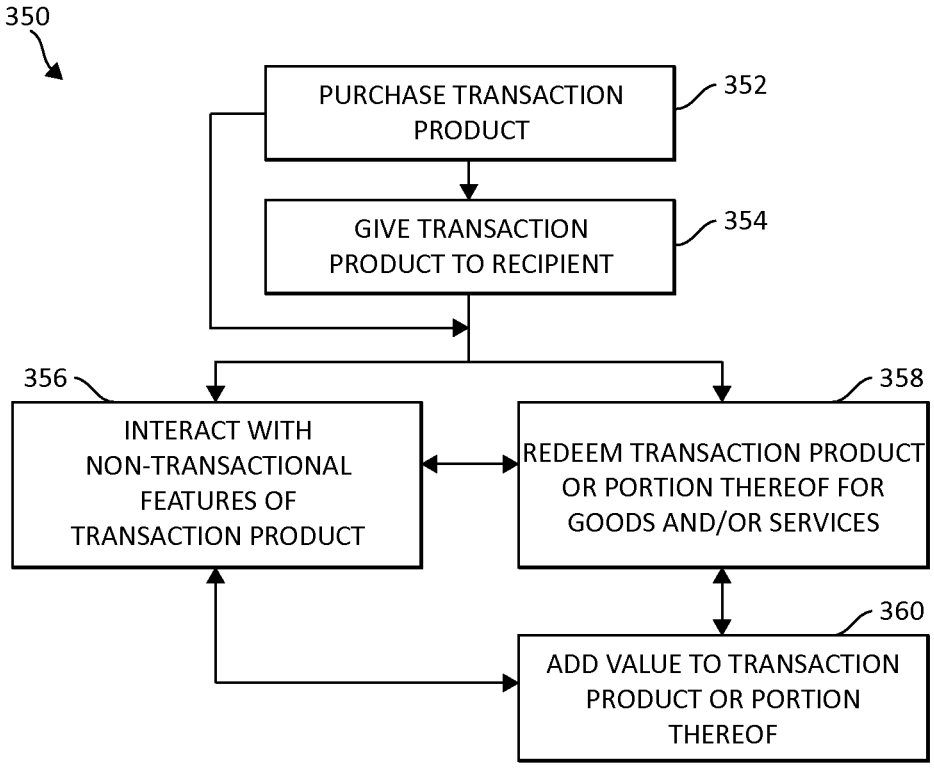
FIG. 14 is a flow chart illustrating a method of using a transaction product assembly, according to one embodiment of the present invention.

FIG. 14 is a flow chart illustrating one embodiment of a method 350 of using transaction product assembly 10. At 352, a potential consumer of transaction product assembly 10, which is displayed in a retail store or viewed on a website, decides to and does purchase transaction product assembly 10 from the retail store or website. Upon purchasing transaction product assembly 10, a retail store employee, a retail store kiosk or other person or device scans account identifier 30 (FIGS. 3 and 5) through opening 272 of backer 250 or otherwise reads or accesses account identifier 30. Upon accessing account identifier 30, the account or record linked to account identifier 30 is accessed and activated to load value onto transaction product 12 (i.e., load value to the account or record associated with transaction product 12). In one embodiment, such as where transaction product assembly 10 is purchased at 352 via a website, actual scanning or other mechanical detection of account identifier 30 may be eliminated.

At 354, the consumer optionally gives transaction product assembly 10 to a recipient, such as a graduate, relative, friend, expectant parents, one having a recent or impending birthday, a couple having a recent or impending anniversary, etc. In one embodiment, a plurality of transaction product assembly 10 are purchased and given to partygoers, such as at a birthday party, etc. as party favors or gifts. As an alternative, the consumer can keep transaction product assembly 10 for his or her own use thereby eliminating operation 354.

At 356, the consumer, recipient, or other current bearer of transaction product assembly 10 interacts with the non-transactional features thereof for amusement. More specifically, the bearer of transaction product assembly 10 removes transaction product 12, auxiliary vehicle 14, and/or writing utensil 16 from package 18. For example, transaction product 12 is unfolded revealing track 20 as illustrated in FIG. 6 and auxiliary vehicle 14 is activated and placed on track 20 such that auxiliary vehicle independent travels along track 20. Additionally or alternatively, unfolded transaction product 12 is flipped over revealing second surface 92 of intermediate sheet 44 as shown in FIG. 7. The bearer can then use writing utensil 16 or other suitable writing or painting utensil to draw her own, customized track, and then use the auxiliary vehicle 14 with the new track. The above-described and similar use as will be apparent to those of skill in the art after reading this application amuses the bearer and any other observers of transaction product 12.

At 358, the consumer or recipient redeems transaction product 12 for goods and/or services from the retail store or website. At 360, the consumer or recipient of transaction product 12 optionally adds value to transaction product 12, more particularly, to the account or record associated with account identifier 30 included therewith, at the retail store or over the Internet (i.e., via the website). Upon interacting with the non-transaction feature of transaction product 12 at 356, redeeming transaction product 12 at 358 or adding value to transaction product 10 at 360, the consumer or recipient of transaction product assembly 10 subsequently can perform any of operations 356, 358, and 360 as desired. In one embodiment, the ability of the consumer or recipient to repeat redeeming transaction product 12 at 358 is limited by whether the account or record linked with transaction product 12 has any remaining value stored or recorded therein at the time of attempted redemption.

Although described above as occurring at a single retail store or website, in one embodiment, purchasing transaction product assembly 10 at 352, redeeming transaction product 12 at 358, and adding value to transaction product 12 at 360 can each be performed at any one of a number of stores adapted to accept transaction product 12 or over the Internet. In one example, a number of stores are each part of a chain or are similarly branded stores. In one example, a number of stores include at least one website and/or at least one conventional brick and mortar store.

Transaction products come in many forms, according to embodiments of the invention. Stored-value cards, like other transaction products, can be "re-charged" or "re-loaded" at the direction of the original consumer, the gift recipient or a third party. The term "loading on" or "loaded on" herein should be interpreted to include adding to the balance of an account or record associated with a transaction card. The balance associated with the transaction card declines as the card is used, encouraging repeat visits or use. The card remains in the user's purse or wallet, serving as an advertisement or a reminder to revisit the associated merchant. Stored-value cards according to embodiments of the invention provide a number of advantages to both the consumer and the merchant. Other transaction products according to embodiments of the invention include loyalty cards, merchandise return cards, electronic gift certificates, calling cards, employee cards, frequency cards, prepaid cards and other types of cards associated with or representing purchasing power, monetary value, etc.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A transaction product assembly comprising:

a transaction product including a folded sheet configured to be repeatedly folded and unfolded between a collapsed position and an extended position, wherein:

the folded sheet defines a first planar surface defining a printed track, the transaction product further comprises an account identifier statically connected thereto, and the account identifier links the transaction product to at least one of an account and a record and is machine readable by a point-of-sale terminal; and an auxiliary vehicle including a microcontroller, one or more sensors, a motor, and at least one movable component, wherein:

the microcontroller actuates the motor to induce movement of the at least one movable component in a manner propelling the auxiliary vehicle along and following the printed track based on detection of a location of the printed track as determined by the one or more sensors.

2. The transaction product assembly of claim 1, wherein the account identifier is a bar code.

3. The transaction product assembly of claim 1, wherein the account identifier includes at least one of a bar code, a magnetic strip, a smart chip, and a radio frequency identification (RFID) device.

4. The transaction product assembly of claim 1, wherein each of the one or more sensors is an image sensor configured to detect differences in light reflected from the printed track and light reflected from areas surrounding the printed track.

5. The transaction product assembly of claim 4, wherein the one or more sensors includes at least two sensors each positioned on an opposite side of the auxiliary vehicle in a manner configured to straddle the printed track and induce correction of the movement of the at least one movable component when one or more of the at least two sensors detects an edge of the track.

6. The transaction product assembly of claim 1, further comprising:

a package enclosing the transaction product and the auxiliary vehicle, wherein the package includes a transparent or translucent clamshell providing visual access to each of the transaction product and the auxiliary vehicle.

7. The transaction product assembly of claim 6, wherein:

the package comprises a support panel secured to the transparent or translucent clamshell, and the transaction product and the auxiliary vehicle are maintained between the support panel and the transparent or translucent clamshell.

8. The transaction product assembly of claim 7, wherein the support panel includes an aperture opposite the clamshell providing access to the account identifier through a portion of the support panel.

9. The transaction product assembly of claim 8, wherein the support panel includes indicia indicating how the transaction product and the auxiliary vehicle are usable together for non-transactional purposes.

10. The transaction product assembly of claim 7, wherein the transparent or translucent clamshell defines a separate cavity for receiving each of the transaction product and the auxiliary vehicle such that the transaction product and the auxiliary vehicle remained spaced apart from one another within the package.

11. The transaction product assembly of claim 1, further comprising a writing utensil.

12. The transaction product assembly of claim 11, wherein the writing utensil has a writing tip with a thickness equal to a thickness of a second track that is detectable by the one or more sensors such that the auxiliary vehicle is configured to move along the second track.

13. The transaction product assembly of claim 11, further comprising:

a package enclosing the transaction product, the auxiliary vehicle, and the writing utensil, wherein the package includes a transparent or translucent clamshell providing visual access to each of the transaction product, the auxiliary vehicle, and the writing utensil within the package.

14. The transaction product assembly of claim 1, wherein:

the folded sheet defines a second planar surface opposite the first planar surface, and the second planar surface defines a blank area and indicia instructing a user to draw a second track for the auxiliary vehicle to move along.

15. The transaction product assembly of claim 1, wherein:

the at least one movable component includes four wheels, the auxiliary vehicle further comprises a protruding cone extending from a bottom surface of the auxiliary vehicle substantially centered between the four wheels, the protruding cone is rotatable and configured to skim the track, and when the one or more sensors indicate the auxiliary vehicle is moving off the track, the microcontroller steers the auxiliary vehicle by directing impeded movement of at least one or more of the four wheels such that the auxiliary vehicle pivots about the protruding cone on the track.

16. The transaction product assembly of claim 1, wherein the transaction product defines a plurality of fold lines, and the fold lines are perforated to facilitate planar extension of the folded sheet when the folded sheet is unfolded and in the extended position.

17. A stored-value assembly comprising:

means for providing a planar pathway, the means for providing the planar pathway including means for linking the means for providing with at least one of an account and a record having a value associated therewith such that the means for providing can be used as payment toward a purchase of one or more of goods and services, wherein the means for linking is machine readable by a point-of-sale terminal; and means for mechanically moving along the planar pathway of the means for providing, the means for mechanically moving including:

means for detecting whether movement of the means for mechanically moving is following the planar pathway, and means for adjusting movement of the means for mechanically moving when the means for detecting determines the means for mechanically moving is not following the planar pathway.

18. The stored-value assembly of claim 17, further comprising means for drawing a second pathway separate from the planar pathway.

19. The stored-value assembly of claim 18, wherein the means for providing, the means for mechanically moving, and the means for drawing are all enclosed within a means for presenting for retail sale.

20. The stored-value assembly of claim 17, wherein the means for adjusting movement includes means for pivoting an orientation of the means for mechanically moving to turn the means for mechanically moving when the means for detecting determines the means for mechanically moving is not following the planar pathway.

21. A method of constructing and facilitating use of a stored-value product linked to a record or an account, the method comprising:

placing the stored-value product into a stored-value assembly package, wherein:

the stored-value product includes a folded sheet configured to be repeatedly folded and unfolded between a folded configuration and an unfolded configuration, the folded sheet defines a printed pathway when the folded sheet is in the unfolded configuration, and the stored-value product is rigidly connected to an account identifier linking the stored-value product to the record or the account having a value associated therewith;

placing a mechanically moveable article into the stored-value assembly package, wherein the mechanically moveable article is configured to move along the printed pathway including detecting when the mechanically moveable article starts to leave the printed pathway with one or more sensors and to correct a direction of movement of the mechanically moveable article when it is detected that the mechanically moveable article starts to leave the printed pathway;

displaying the stored-value assembly package with the stored-value product and the mechanically moveable article, wherein displaying the stored-value assembly package includes promoting non-transactional use of the stored-value product in the unfolded configuration to provide the printed pathway in combination with the mechanically moveable article, which is configured to move along the printed pathway.

22. The method of claim 21, further comprising activating the record or the account linked to the stored-value product to permit subsequent deductions from the value associated with the record or the account for application toward one of a purchase and a use of one or more of goods and services based on the account identifier of the stored-value product.

* * * * *